United States Patent [19]

Bruner

[11] Patent Number: 4,566,734

[45] Date of Patent: Jan. 28, 1986

[54] ADJUSTABLE BOAT SEAT PEDESTAL

[76] Inventor: Andrew L. Bruner, 5924 Chaucer La., Little Rock, Ark. 72209

[21] Appl. No.: 643,721

[22] Filed: Aug. 24, 1984

[51] Int. Cl.[4] ..... A47C 1/02

[52] U.S. Cl. ..... 297/346; 248/159; 114/363; 297/15

[58] Field of Search ..... 297/345, 346, 15; 296/65 R; 248/419, 423, 159; 114/363

[56] References Cited

U.S. PATENT DOCUMENTS

| | | | |
|---|---|---|---|
| 2,299,909 | 10/1942 | Linderme | 248/159 |
| 2,459,280 | 1/1949 | Lange et al. | 248/159 |
| 2,946,373 | 7/1960 | McCanse et al. | 297/349 X |
| 3,300,172 | 1/1967 | Noller et al. | 248/425 |
| 3,412,968 | 11/1968 | Rose et al. | 248/425 |
| 3,428,976 | 2/1969 | Robinson | 114/363 X |
| 3,437,373 | 4/1969 | Boston | 296/65 R |
| 3,515,432 | 6/1970 | Sporman | 297/347 |
| 3,642,320 | 2/1972 | Ward | 297/345 |
| 3,708,203 | 1/1973 | Barecki et al. | 297/349 |
| 3,718,365 | 2/1973 | Gibson | 297/349 |
| 3,839,757 | 10/1974 | Grimes | 297/192 X |
| 3,920,276 | 11/1975 | Sparrow | 297/142 |
| 4,134,617 | 1/1979 | Matsubara | 297/345 |
| 4,279,398 | 7/1981 | Pergnall | 248/405 |
| 4,432,525 | 2/1984 | Duvall | 114/363 X |

FOREIGN PATENT DOCUMENTS

| | | | |
|---|---|---|---|
| 573115 | 3/1924 | France | 297/15 |
| 663099 | 3/1929 | France | 297/346 |
| 803900 | 7/1936 | France | 248/159 |

*Primary Examiner*—James T. McCall

*Attorney, Agent, or Firm*—Peter L. Klempay

[57] ABSTRACT

A pedestal mounting for a boat seat which selectively positions the seat in a centrally located, elevated position or an offset, lowered position. The pedestal includes a column formed of pivotally connected elongated members and a sleeve telescopingly received on the members and a base with an open-ended tube receiving the lowermost of the elongated members.

9 Claims, 6 Drawing Figures

FIG. 2
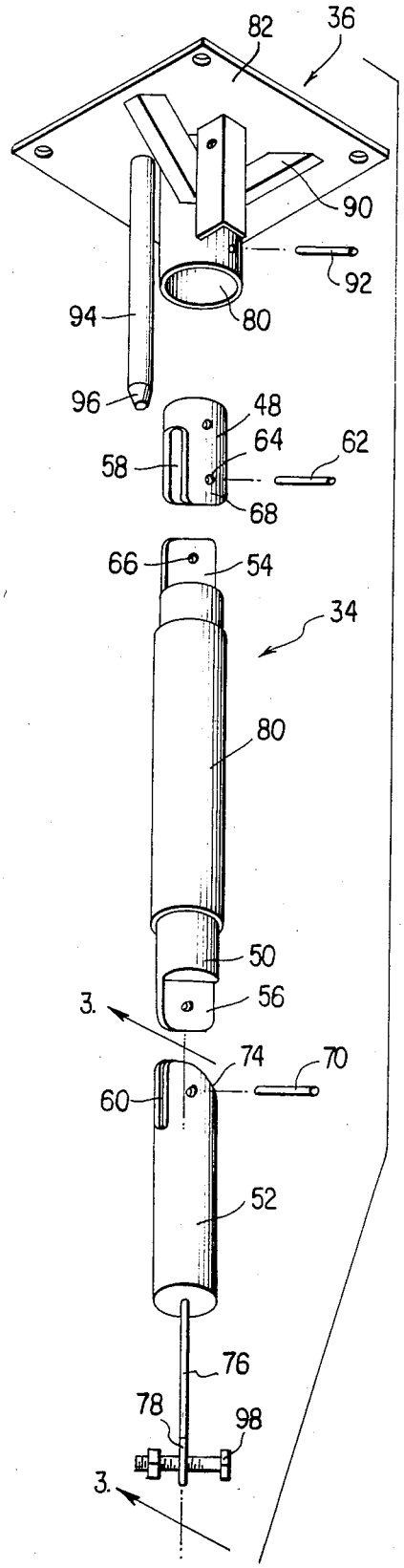
FIG. 3
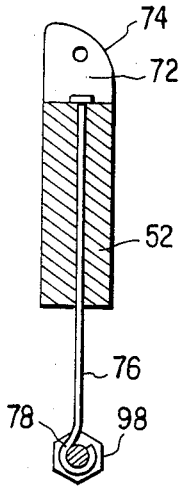
FIG. 4
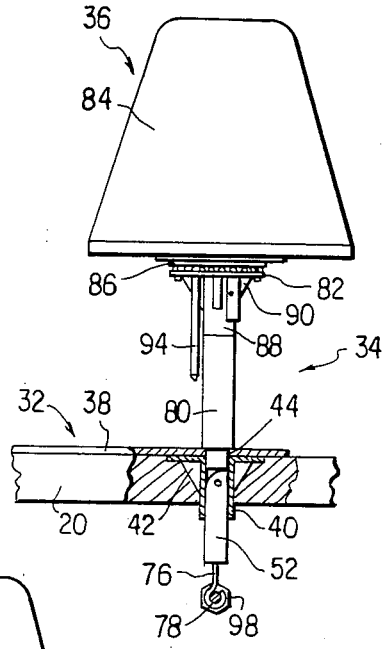
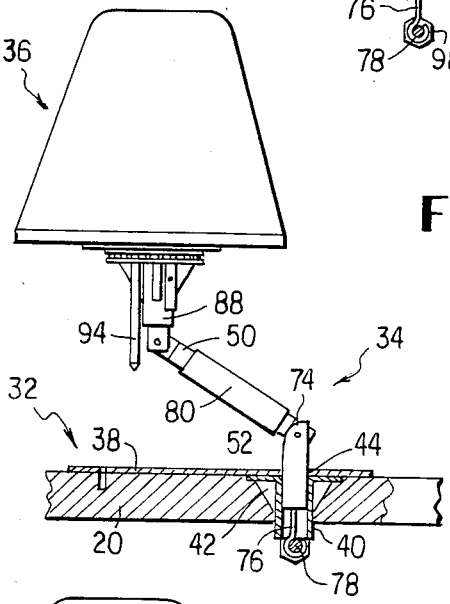
FIG. 5
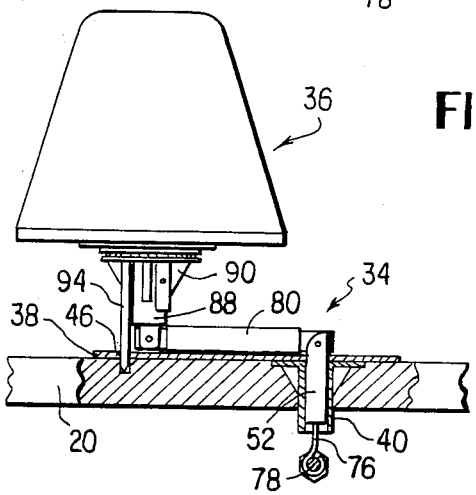
FIG. 6

ADJUSTABLE BOAT SEAT PEDESTAL

The present invention pertains to mounting pedestals for boat seats and, more particularly, to such pedestals which permit shifting of the seat between an elevated, central position and a lowered, laterally offset position.

BACKGROUND OF THE INVENTION

When fishing from an open boat, it is preferrable that the fisherman's seat be located on the centerline of the boat for stability and at an elevated position for optimum visibility and maneuverability of the fishing gear. When operating the boat, however, it is preferrable that the seat be at a lower position and, in a boat equipped with an outboard motor mounted on the transom, the seat is necessarily offset from the centerline of the boat to allow for control of the motor. In boats which are also equipped with one or more forward fishing seats, it is again desireable to be able to shift these seats between centrally located, elevated positions for use while fishing and offset, lower positions when running in order that the vision of the operator is not obstructed.

Various mounting arrangements for fishing boat seats are disclosed in the prior art. U.S. Pat. No. 3,642,320, Ward, for example, shows a vertically adjustable pedestal for a swivel chair, the arrangement permitting the seat to be placed in an elevated, rearwardly facing position when fishing or a lowered, forwardly facing position when running. It is not possible, however, to shift the seat laterally. Mounting arrangements which permit lateral shifting of a boat seat but not elevation thereof are shown in U.S. Pat. Nos. 3,718,365, Gibson and 4,432,525, Duvall. In U.S. Pat. No. 3,839,757, Grimes, a seat mounting arrangement is disclosed which permits movement of the seat between a forward, elevated position and a more rearward, lower position, the seat being supported by plural arms on a console.

While various dual position boat seats have heretofor been proposed, there is a need for such a seat which may be positioned either in an elevated, centrally located position or in a laterally offset, lower position. Such an arrangement is particularly advantageous for use in a boat having an outboard motor as the lowered position of the seat provides a convenient location for controlling the motor while running.

It is, accordingly, the primary object of the present invention to provide a boat seat mounting pedestal for supporting the seat in an elevated position on the centerline of the boat or a lowered position laterally offset from the centerline.

It is also an object of the invention to provide a boat seat mounting pedestal which provides for adjustable positioning of the seat and which may be installed in a boat with a minimum of alteration thereto.

It is a further object of the invention to provide such a seat mounting pedestal which provides secure locking of the seat in either the lowered or elevated position while eliminating the need for hand manipulated latches, pins or other securing members.

SUMMARY OF THE INVENTION

The above and other objects of the invention which will become apparent hereinafter are achieved by the provision of a boat seat mounting pedestal which includes a base plate mountable on a seat or deck structure of a boat and having a downwardly projecting, open-ended tube secured thereto; a supporting shaft having three hingedly interconnected sections, the lower section being slideably received in the tube of the base plate; a mounting plate for a seat swivel affixed to the upper end of the uppermost section of the support column; and a tubular sleeve telescopingly received over the support column, the column sections and the tubular sleeve being of such lengths that, when the support column sections are axially aligned, the lowermost section and the hinge connection to the lower end of the intermediate section are received in the tube of the base plate and the tubular sleeve surrounds the remainder of the intermediate section and the hinge connection between that section and the uppermost section. Preferrably, a locking pin projects downwardly from the upper column section in parallel, offset relation thereto and the base plate includes an aperture for receiving this pin when the seat is in its lowered position.

For a more complete understanding of the invention and the objects and advantages thereof, reference should be had to the following detailed description and the accompanying drawings wherein a preferred embodiment of the invention is described and illustrated.

BRIEF DESCRIPTION OF THE DRAWINGS

In the drawings:

FIG. 2 perspective, exploded view of the seat pedestal;

FIG. 3 is a cross-sectional view taken on the line 3—3 of FIG. 2;

FIG. 4 is a front elevational view, partially in section, showing the seat pedestal in its elevated position;

FIG. 5 is a front elevational view, partially in section, showing the seat pedestal in its lowered position; and FIG. 6 is a front elevational view, partially in section, showing the seat pedestal in a position intermediate of those positions in FIGS. 4 and 5 and in the process of transition therebetween.

DESCRIPTION OF THE PREFERRED EMBODIMENT

Figure 1:
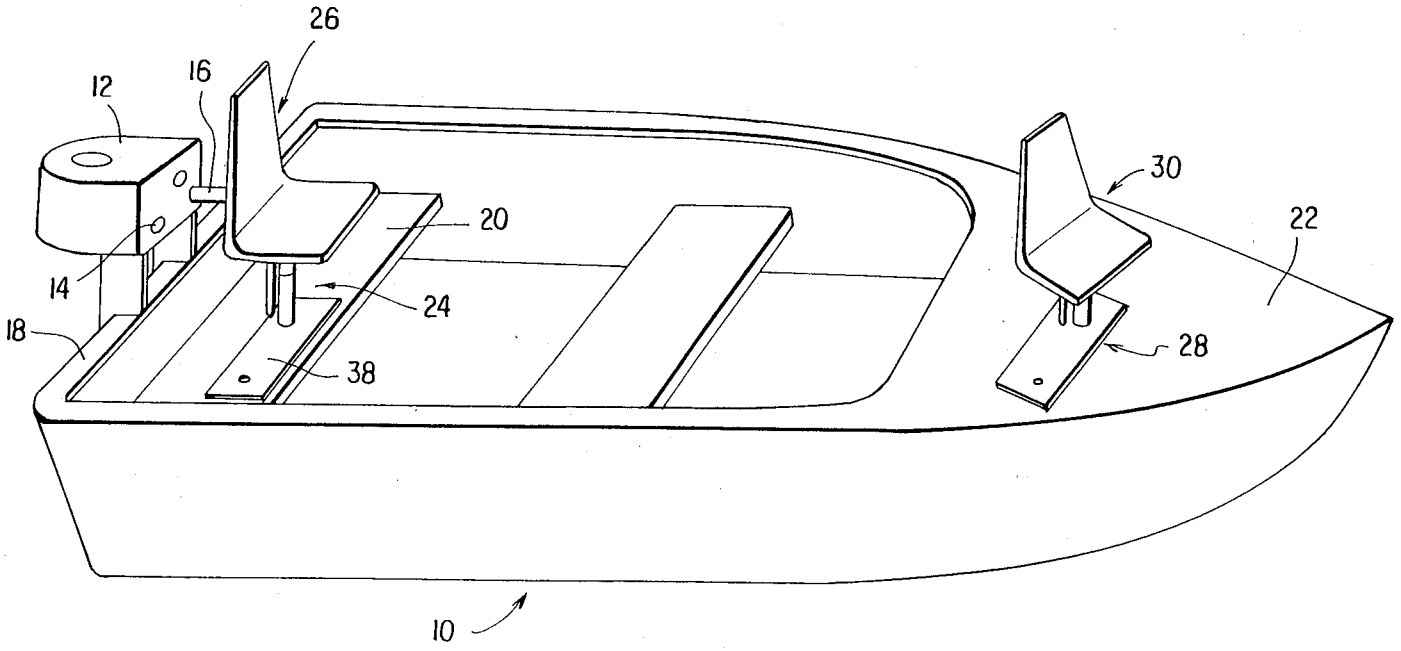
FIG. 1 is a perspective view of an open fishing boat equipped with the adjustable seat pedestal of the present invention.

Having reference now to FIG. 1, there is shown an open boat 10 provided with an outboard motor 12 having starting controls 14 and a controlling tiller handle 16, the outboard motor being mounted on the transom 18 of the boat in the conventional manner. As is also conventional, the boat is furnished with a fixed rear seat 20 immediately forward of the transom and may also have one or more additional seats and a forward deck area 22. Mounted on the rear seat 20 is the adjustable pedestal 24 of the present invention, the pedestal serving to support a fishing seat 26. A second pedestal 28 and second fishing seat 30 may also be mounted on the forward deck area.

The adjustable seat pedestal includes a base 32, adjustable support column 34 and a seat mounting 36. The base includes a generally rectangular plate 38 adapted to be bolted or otherwise secured to the fixed seat 20 or, in the case of the forwardly mounted seat pedestal 28, to the deck 22. A downwardly extending, open-ended tube 40 is attached to the plate 38, for example, by welding, gussets 42 being provided to brace the assembly. The plate 38 has a first circular aperture 44 aligned with the tube 40 and a second aperture 46 laterally offset from the first aperture.

As can be seen from FIGS. 2 and 3, the support column 34 is formed of three cylindrical bars 48, 50, 52, the middle one 50 of which is cut away at each end to provide centrally located, flat sided lugs 54, 56 and the corresponding ends of the upper 48 and lower 52 bars provided with slots 58, 60, respectively, for receiving the corresponding lugs. A pin 62 passes through holes 64 in the slotted lower end of the upper bar 48 and a hole 66 in the upper lug 54 to hingedly connect these two members together. A second pin 70 serves to hingedly connect the lower end of the middle bar 50 to the slotted upper end 72 of the lower bar 52. The two pins 62 and 70 and, accordingly, the axes of the pivotal connections are parallel. The lower end 68 of the upper bar is uniformly rounded and, as can be seen from FIG. 3, the upper end 72 of the lower bar is rounded asymmetrically, having a downwardly curving surface 74 on one side of the axis of the pin 70. A rod 76 is mounted coaxially in the lower bar 52 and projects downwardly therefrom, terminating in an eye 78. A tubular sleeve 80 is telescopingly received over the middle bar 50, the sleeve being slightly shorter than the distance between the junctures of the lugs 54 and 56 and the body of the bar.

The seat mounting 36 includes a square or rectangular plate 82 to which the seat assembly 84, preferrably including a swivel base 86, is attached. Centrally located on the underside of the plate 82 is a downwardly extending tube 88 secured thereto by welding, for example, and having bracing members 90. The upper end of the upper bar 48 of the support column is telescopingly received in the tube 88 and secured thereto by pin 92. Located adjacent to the tube 88 and extending parallel thereto is a rod 94 having a tapered lower end 96, the length of the rod being slightly greater than the overall length of the tube 88 and the upper bar 48 assembly.

The seat assembly is shown in its elevated position, used when fishing, in FIG. 4 and in its lowered, offset position, used when running, in FIG. 5. When in the elevated position, the lower bar 52 and the lower end of the middle bar 54 are received within the tube 40 of the base 32 and the lower end of the sleeve 80 bears against the base plate 38 while the upper end thereof engages the lower end of the tube 88 of the seat mounting, the sleeve overlying the hinged connection between the upper and middle bars 48, 50.

In order to shift the seat to its lowered, offset position, the seat is lifted upwardly, as shown in FIG. 6. As the seat is raised, the sleeve 80 moves downwardly on the middle bar 50 to uncover the hinged connection to the upper bar 48. Upward movement of the seat also brings the hinged connection between the middle and lower bars 50, 52 above the tube 40 and, as the seat is moved to the side, the curved upper surface 74 of the lower bar engages the lower end of the sleeve 80 to maintain the sleeve above the lower hinged connection. When the seat is fully lowered, the tapered end 96 of the rod 94 enters the aperture 46 of the base plate 38 so that the seat is securely positioned. To prevent accidental removal of the seat assembly from the base when shifting between the lower and upper positions, a bolt 98 is carried by the eye 78 of the downwardly projecting rod 76 and serves as a stop limiting the upward movement of the seat.

It will be apparent that the seat mounting pedestal described above provides an adjustable fishing seat mounting which is readily and easily moved between an elevated, central position for fishing and a lowered, offset position for running, the lowered position being particularly adapted to permit acess to the controls of an outboard motor.

While a preferred embodiment of the invention has been described and illustrated, it will be understood that the invention is not limited thereto as changes and additions may be made therein and thereto without departing from the spirit of the invention. Reference should, accordingly, be had to the appended claims in determining the true scope of the invention.

I claim:

1. A mounting pedestal for a boat seat movable between an elevated seating position and a lowered seating position comprising:

a base adapted to be secured to said boat, said base including a first, open-ended tube the axis of which is vertically oriented;

a mounting plate adapted for connection to a seat, said mounting plate having a second, downwardly extending, open-bottomed tube affixed thereto;

a column assembly including a first cylindrical member adapted to be telescopingly received in and secured to said tube, a second cylindrical member, and a third cylindrical member adapted to be telescopingly received in said first tube, said first and second members and said second and third members, respectively, being pivotally connected, the connection between said first and second members being such as to maintain said seat in a seating position in both the upper and lower positions thereof; and a tubular sleeve telescopingly received over said column assembly, the length of said sleeve being less than that of said column member.

2. The mounting pedestal for a boat seat according to claim 1 wherein said first and second members and said second and third members, respectively, are pivotally connected for movement about parallel axes.

3. The mounting pedestal for a boat seat according to claim 2 wherein the ends of said second cylindrical member include lug portions, the lower end of said first cylindrical member and the upper end of said third cylindrical member each having a slotted portion for reception of the corresponding one of said lug portions, and including a pin extending through each slotted portion and each lug portion for pivotally interconnecting the same.

4. The mounting pedestal for a boat seat according to claim 3 wherein the lower end of the slotted portion of said first cylindrical member is uniformly rounded and the upper end of said slotted portion of said third cylindrical member is asymmetrically rounded relative to the axis of said pin.

5. The mounting pedestal for a boat seat according to claim 1 further including a rod secured to said mounting plate and extending downwardly therefrom in parallel, offset relation to said second tube, said rod being of a length slightly greater than that of said second tube, and said base has an aperture adapted to receive the lower end of said rod.

6. The mounting pedestal for a boat seat according to claim 1 further including means extending downwardly from said third cylindrical member for preventing complete removal thereof from said first tube.

7. A mounting pedestal for a boat seat positionable in an elevated seating position or a lowered seating position offset from the elevated position comprising:

a base assembly including a base plate adapted to be secured in said boat and an open-ended tube connected to and extending downwardly from said base plate, said base plate having a first aperture aligned with the upper end of said tube;

a mounting assembly adapted for connection to a seat and having a downwardly extending, open-bottom tube; and a column assembly including a first elongated member adapted to be telescopingly received in said tube of said base assembly, a second elongated member, first means for pivotally connecting the upper end of said first elongated member to the lower end of said second elongated member, said second means being such as to maintain said seat in a seating position in both the elevated and lowered positions thereof, and a sleeve telescopingly received on said second elongated member, the length of said sleeve being less that the distance between said first and second means;

the arrangement being such that, in the elevated position of said seat, said first elongated member and said first means are received within said tube and said sleeve extends upwardly from said base plate to said mounting assembly and surrounds said second means and, in the lowered position of said seat, said sleeve is positioned between said first and second means and extends along said base plate.

8. The mounting pedestal of claim 7 wherein said base plate has a second aperture offset from said first aperture and said mounting assembly includes a rod secured thereto and extending downwardly therefrom, the length of said rod being such that the lower end thereof is received in said second aperture when said seat is in the lowered position.

9. The mounting pedestal of claim 7 wherein the upper end of said first elongated member includes a camming surface adapted to engage the lower end of said sleeve upon movement of said seat between the elevated and the lowered positions thereof.

* * * * *